United States Patent [19]

Makuta

[11] Patent Number: 4,526,478

[45] Date of Patent: Jul. 2, 1985

[54] ELECTRONIC SOUND GENERATING CIRCUIT FOR GENERATION BELL TOLL

[75] Inventor: Shunichi Makuta, Saitama, Japan

[73] Assignee: Rhythm Watch Company Limited, Tokyo, Japan

[21] Appl. No.: 566,025

[22] Filed: Dec. 27, 1983

[30] Foreign Application Priority Data

Dec. 27, 1982 [JP] Japan ..... 57-229468

[51] Int. Cl.[3] ..... G04B 21/00

[52] U.S. Cl. ..... 368/273; 368/272

[58] Field of Search ..... 368/271–273; 84/1.03

[56] References Cited

U.S. PATENT DOCUMENTS 4,328,731 5/1982 Gotho et al. ..... 84/1.03

*Primary Examiner*—Bernard Roskoski

*Attorney, Agent, or Firm*—Koda and Androlia

[57] ABSTRACT

An electronic sound generating circuit for an electronic device having standard signal generator including a first audio frequency signal generating circuit generating a first audio frequency signal, a second audio frequency signal generating circuit generating a second audio frequency signal having a frequency which differs from said first audio frequency signal, a mixing circuit mixing said first audio frequency signal and said second audio frequency signal to provide a mixed signal, and a tone generating circuit generating an audible tone in response to said mixed signal.

7 Claims, 11 Drawing Figures

64Hz
128 Hz
14a
14
16
16a
18
18a
18b
18c
18d
18e
18f
18g
18h
18i
22a
38
39
40
41
42
43
44
45
45a
46
47
48
49
50
51
52
53
54
55
56
58
60
62
63
64
65
66

ELECTRONIC SOUND GENERATING CIRCUIT FOR GENERATION BELL TOLL

BACKGROUND OF THE INVENTION

1. Field of the Invention

This invention relates to improvements in an electronic tone used for the chime of a timepiece or the like. More particularly, the invention relates to an electronic sound generating circuit providing a sound which is closer to that of an actual mechanical tolling bell.

2. Prior Art

Various improvements have been made in the electronic tone used in the chime or melody of timepieces in order to make the electronic tone resembling a tone of an actual mechanical bell toll. For example, one improvement is an envelope effect, wherein the volume of an electronic tone is gradually attenuated with the passage of time.

However, even with these conventional improvements, the generated electronic tone lacks quality and depth of an actual mechanical bell toll.

There are two reasons for this. One is that the conventional artificial electronic tone includes only a single frequency component, whereas an actual mechanical bell toll includes a mixture of several frequency components. The other is that the volume of an actual mechanical bell toll does not merely attenuate with time but the volume undergoes slight changes while attenuating.

A sound produced by mixing several frequencies and by varying volume in small increments cannot be obtained with the frequency or volume varying method conceived of heretofore in the prior art. There is need of a novel method for producing such a sound.

SUMMARY OF THE INVENTION

Accordingly, it is the primary object of this invention to provide an electronic sound generating circuit producing a sound having a peculiar quality and depth, such as a mechanical bell toll.

In keeping with the principles of the present invention, the object is accomplished by an electronic sound generating circuit for an electronic device having a standard signal generating means, comprising a first audio frequency signal generating circuit generating a first audio frequency signal, a second audio frequency signal generating circuit generating a second audio frequency signal having a frequency which differs from said first audio frequency signal by from 1 to 10 Hz, a mixing circuit mixing said first audio frequency signal and said second audio frequency signal to provide a mixed signal, and a tone generating circuit generating an audible tone in response to said mixed signal.

BRIEF DESCRIPTION OF THE DRAWINGS

The above-mentioned features and objects of the present invention will become more apparent by reference to the following description taken in conjunction with the accompanying drawings in which.

DETAILED DESCRIPTION OF THE INVENTION

Figure 1A:
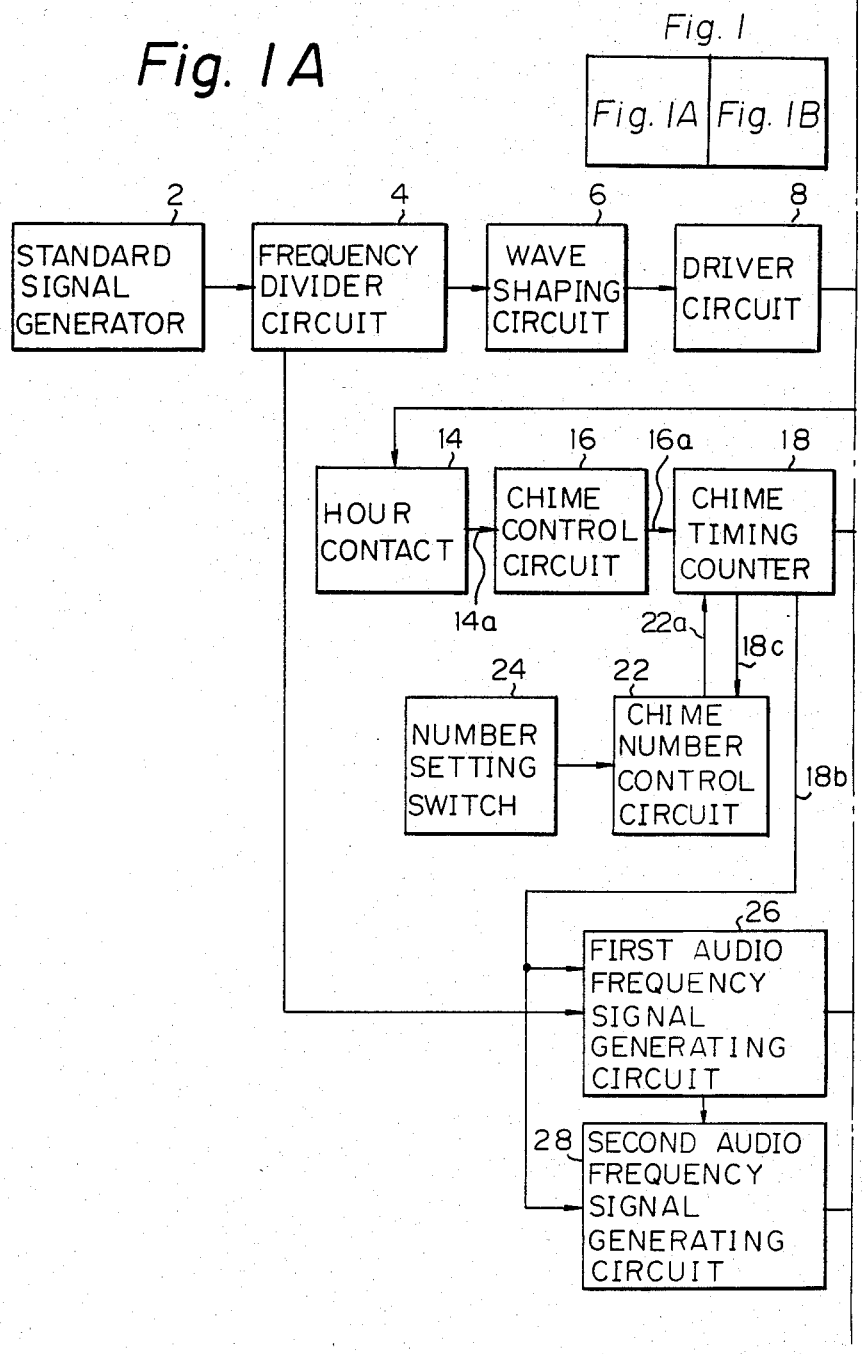
FIGS. 1A, 1B are a block circuit diagram illustrated an embodiment of the present invention.
Figure 1B:
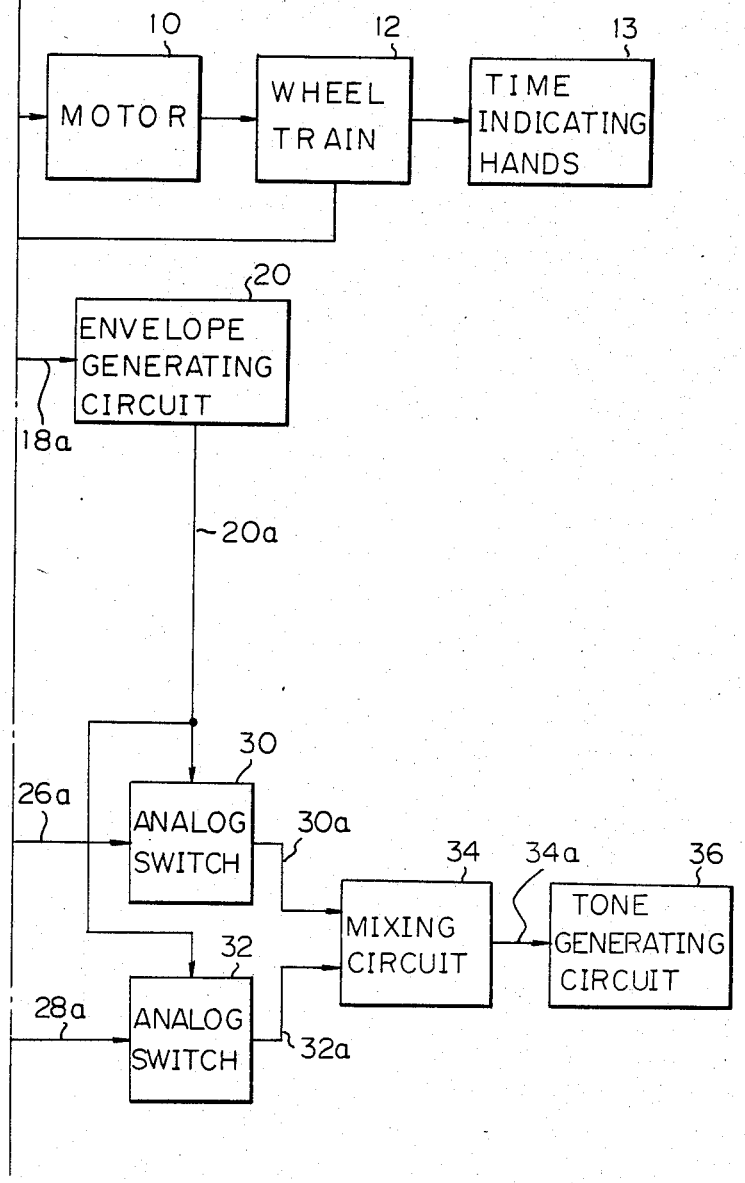

FIG. 1 is a block circuit diagram illustrated an embodiment of the present invention. In the illustrated embodiment, the invention is utilized to produce the chime of a timepiece.

In FIG. 1, reference numeral 2 denotes a standard signal generator, 4 a frequency divider circuit, 6 a wave shaping circuit, 8 a driver circuit, 10 a motor, 12 a wheel train, 13 a time indicating hands. These constitute an arrangement similar to that of the conventional analog display timepiece.

Reference numeral 14 denotes an hour contact which is incorporated within the wheel train 12. The hour contact 14 is closed exactly on the hour and then produces an ON signal 14*a*. In response to the signal 14*a*, a chime control circuit 16 produces a chime start signal 16*a*. The chime start signal 16*a* is applied to a chime timing counter 18. In response to the chime start signal 16*a*, the chime timing counter 18 counts the number of chimes and applies an envelope start signal 18*a* to an envelope generating circuit 20 and, at the same time, produces a reset release signal 18*b* for releasing first and second audio frequency signal generating circuit 26, 28 from the reset state. Further, a count signal 18*c* is applied to a chime number control circuit 22 which detects whether the count signal attains a value set for the count. If the set value is attained, the chime number control circuit 22 supplies a chime stop signal 22*a* to the chime timing counter 18. The number of chimes is set in the chime count control circuit 22 by operating a number setting switch 24.

In this embodiment, the first audio frequency signal generating cirucit 26 produces a first audio frequency signal 26*a* in response to the signal 18*b* from the chime timing counter 18. The second audio frequency signal generating circuit 28 produces a second audio frequency signal 28*a* in response to the signal 18*b* from the chime timing counter 18. The second audio frequency signal 28*a* has a frequency differing from the first audio frequency signal by from 1 to 10 Hz.

The first and second audio frequency signals 26*a*, 28*a* are applied to analog switches 30, 32, respectively. The analog switches 30, 32 also receive an envelope signal 20*a* from the envelope generating circuit 20 and convert the signals 26*a*, 28*a* into signals 30*a*, 32*a* having a gradually attenuated amplitude in accordance with the envelope signal 20*a*. The attenuated signals 30*a*, 32*a* from the analog switches 30, 32 are applied to a mixing circuit 34 and are mixed by the mixing circuit 34. A mixed signal 34*a* is applied to a tone generating circuit 36, whereby the tone generating circuit 36 generates a sound having a peculiar quality and depth, such as a mechanical bell toll.

The sound generated by the tone generating circuit 36 in the present invention comprises the first and second frequency which are attenuated. Therefore, the sound in the present invention resembles a real bell toll.

Figure 2:
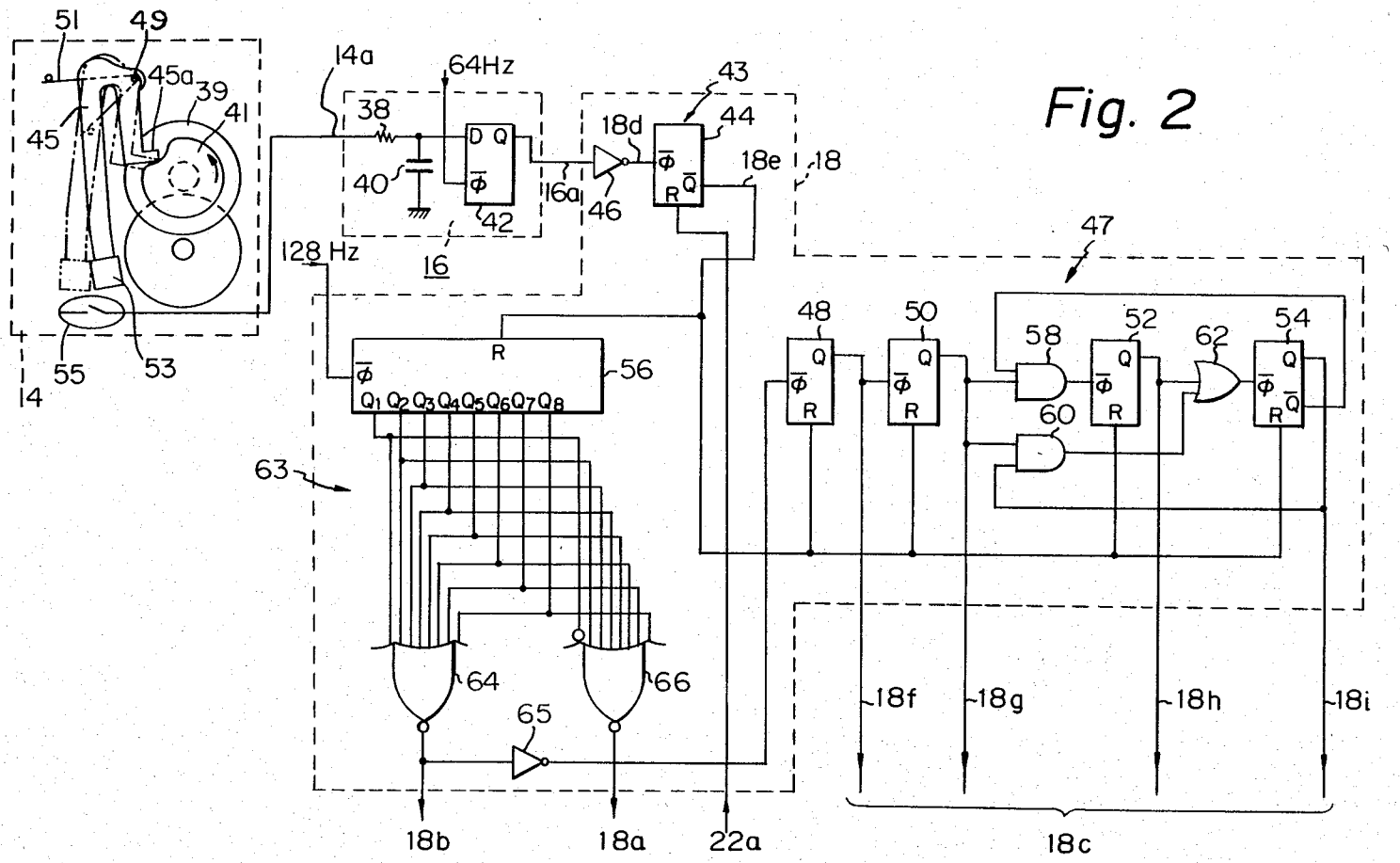
FIG. 2 is a structure of the hour contact and more detailed circuits of the chime control circuit and chime timing counter shown in FIG. 1.
Figure 3:
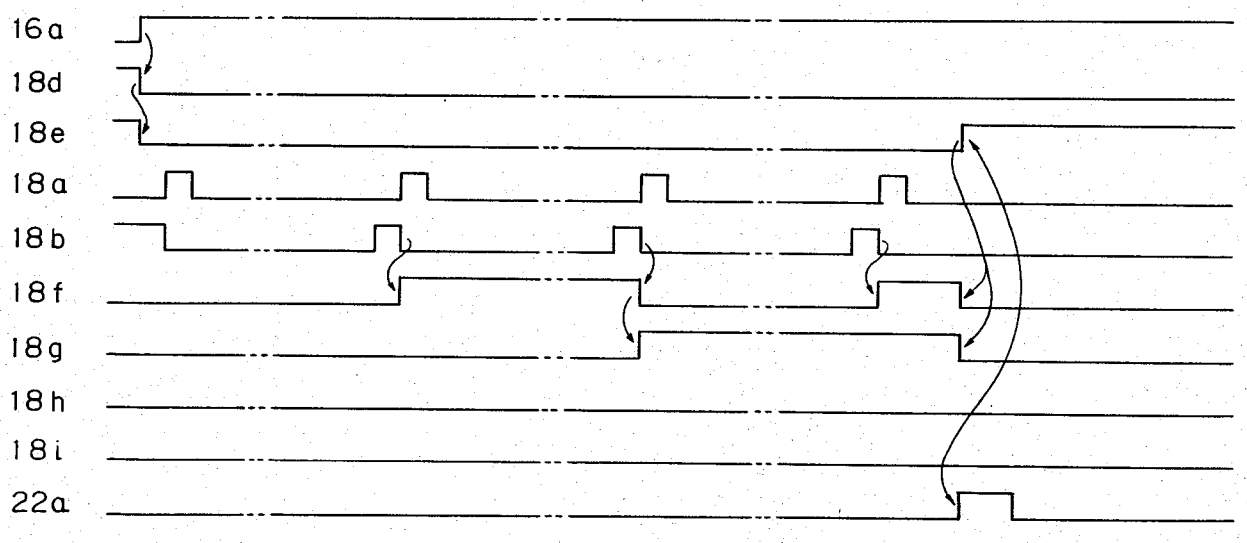
FIGS. 3 and 4 are time charts of various signals used in the circuits of FIG. 2.
Figure 4:
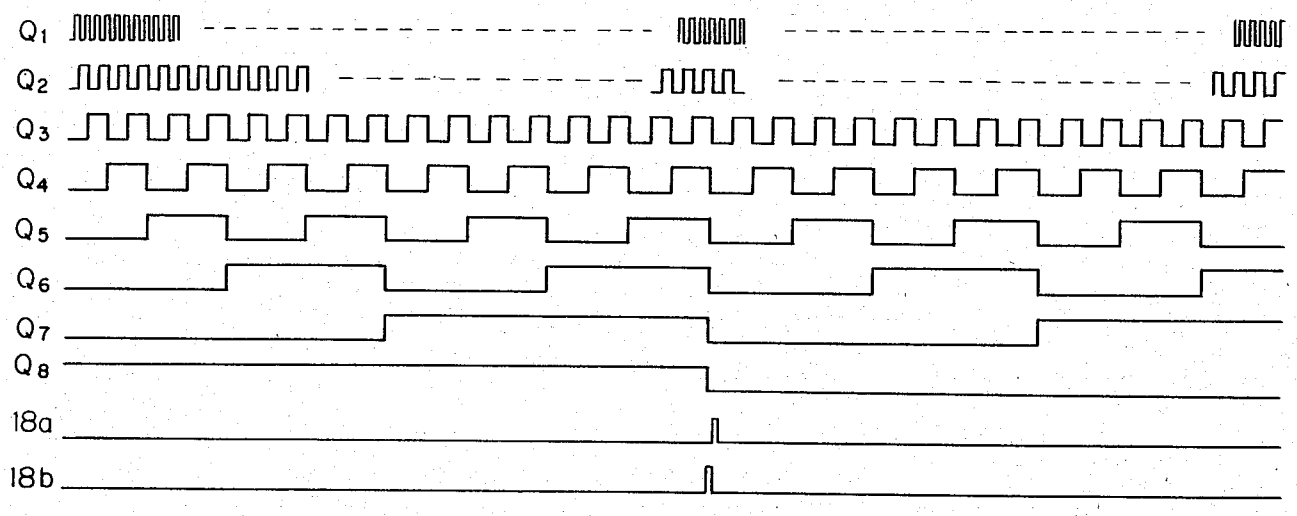

FIG. 2 shows a structure of the hour contact 14 and more detailed circuits of the chime control circuit 16 and chime timing counter 18 shown in FIG. 1. FIGS. 3 and 4 are time charts of various singals used in the circuits of FIG. 2. The hour contact 14 comprises a cam 41 fixed to a minute wheel 39 which rotates once in every hour, a lever 45 rotatably supported by a pin 49 and urged in the counterclockwise direction by a spring 51, a magnet 53 provided at one end of the lever 45 and a switch 55 disposed adjacent the magnet 53. The lever 45 is normally positioned as shown by the dotted line with the magnet 53 away from the switch 55. In this state, the switch 55 is in an off condition. At the right hour, a cam follower portion 45*a* provided at the upper end of the lever 45 engages the notch of the cam 41, whereby the lever 45 rotates to the position shown by the solid line. As a result, the magnet 53 comes adjacent the switch 55, therefore, the switch 55 becomes the on condition and produces the signal 14*a*. In FIG. 2, the chime control circuit 16 is shown as comprising a resistance 38, a condenser 40 and a flip-flop 42 having a terminal D connected to the hour contact 14 through the resistance 38 and condenser 40 and a terminal $\overline{\phi}$ receiving 64 Hz signal from the frequency divider circuit 4.

The chime timing counter 18 comprises a reset circuit 43 composed of a flip-flop 44 and an inverter 46, a counter circuit 47 composed of flip-flops 48, 50, 52, 54 reset by a signal 18*e* from the flip-flop 44 and gates 58, 60, 62 and a timing signal generating circuit 63 composed of a counter 56 reset by the signal 18*e*, NOR gate 66 providing an envelope start signal 18*a* and NOR gate 64 providing a reset signal 18*b*.

As shown in FIG. 3, the flip-flop 42 of the chime control circuit 16 is responsive to the signal 14*a* provided from the hour contact 14 exactly on the hour to change the singal 16*a* from the low potential level (referred to hereinafter as the L level) to the high potential level (referred to hereinafter as the H level). The H level signal 16*a* is applied to the reset circuit 43 of the chime timing counter 18 through the inverter 46. The output $\overline{Q}$ of the flip-flop 44 attains to the L level in synchronism with the falling portion of the signal 18*d*. When the signal 18*e* goes to L level, the flip-flops 48, 50, 52, 54 of the counter circuit 47 and the counter 56 of the timing signal generating circuit 63 are released from the reset state, whereby the counter circuit 47 and the timing singal generating circuit 63 begin to operate. When the counter 56 operates, signals as shown in FIG. 4 are provided from the outputs $Q_1$–$Q_8$ of the counter 56. These signals are applied to the NOR gate 64 and NOR gate 66, respectively, whereby pulses appear on the outputs of the NOR gate 64 and NOR gate 66, respectively. The envelope start signal 18*a* is applied to the envelope generating circuit 20. The envelope generating circuit 20 generates the envelope signal in response to the H level pulses which appear in the envelope start signal 18*a*.

On the other hand, the pulsed reset signal 18*b* is applied to the first and second audio frequency signal generating circuits 26, 28. The first and second audio frequency signal generating circuits 26, 28 are released from the reset state in response to the L level portion of the signal 18*b* and are reset in response to every H level portions of the signal 18*b*. The signal 18*b* from the NOR gate 64 is also applied to the clock terminal $\overline{\phi}$ of the flip-flop 48 through an inverter 65. The output Q of the flip-flop 48 is changed to the H or L level in synchronism with every falling portions of the signal 18*b*. Therefore, the outputs Q of the flip-flops 50, 52, 54 are also changed in response to their respective output signals, i.e. the counter circuit 47 counts the number of the pulses appearing in the signal 18*b*.

The output signals 18*f*, 18*g*, 18*h*, 18*i* of the counter circuit 47 are applied to the chime number control circuit 22 and are compared with the chime number which is set by user. When the chime number counted by the chime timing counter 18 is corresponding to the chime number set by user in the chime number control circuit 22, the reset signal 22*a* is provided to the flip-flop 44 of the chime timing counter 18 from the chime number control circuit 22. Then, the flip-flop 44 is reset by the reset signal 22*a*, whereby the signal 18*e* is changed from the L level to the H level. Thus, the flip-flops 48, 50, 52, 54 and the frequency divider circuit 56 are reset again.

Figure 5:
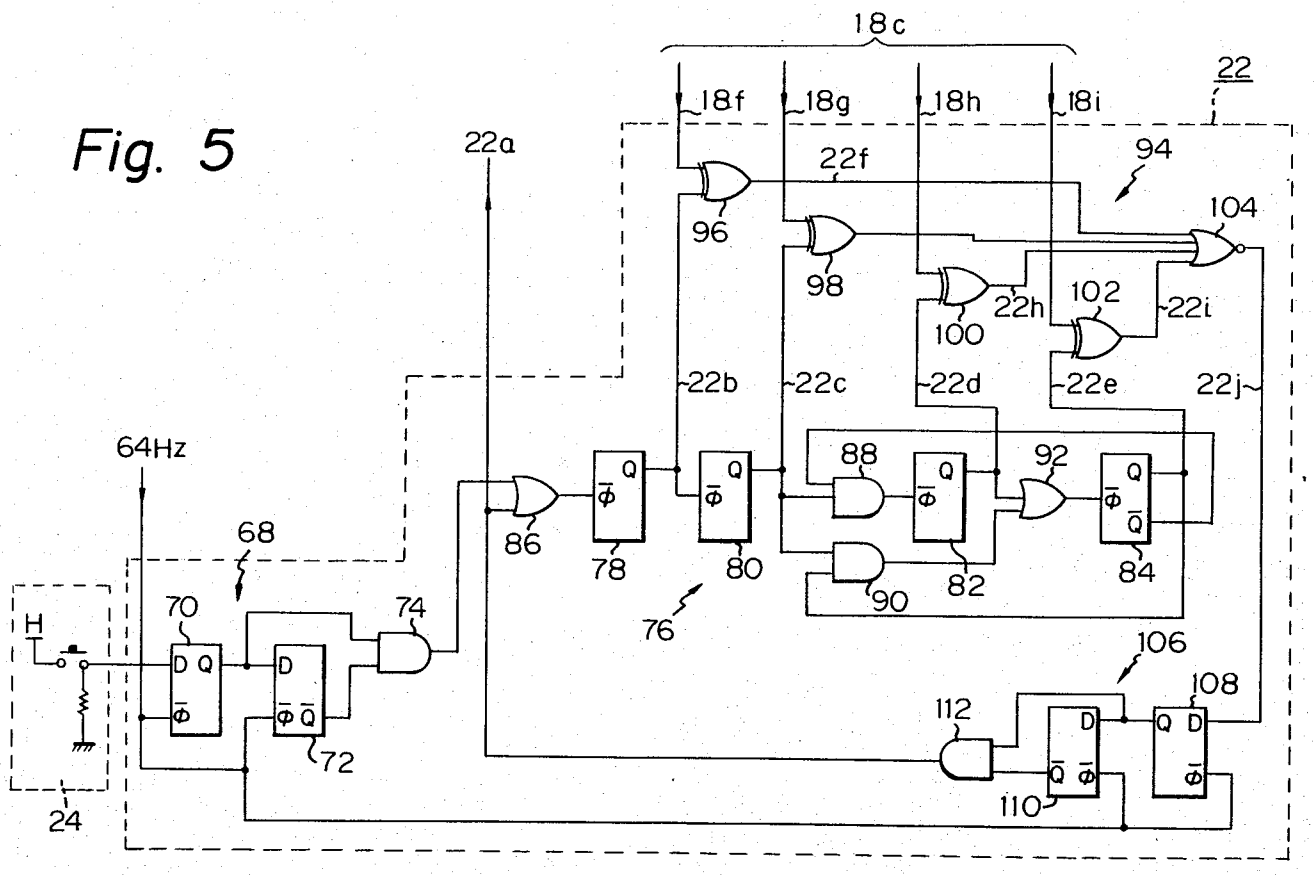
FIG. 5 is a more detailed circuit of the chime number control circuit shown in FIG. 1.
Figure 6:
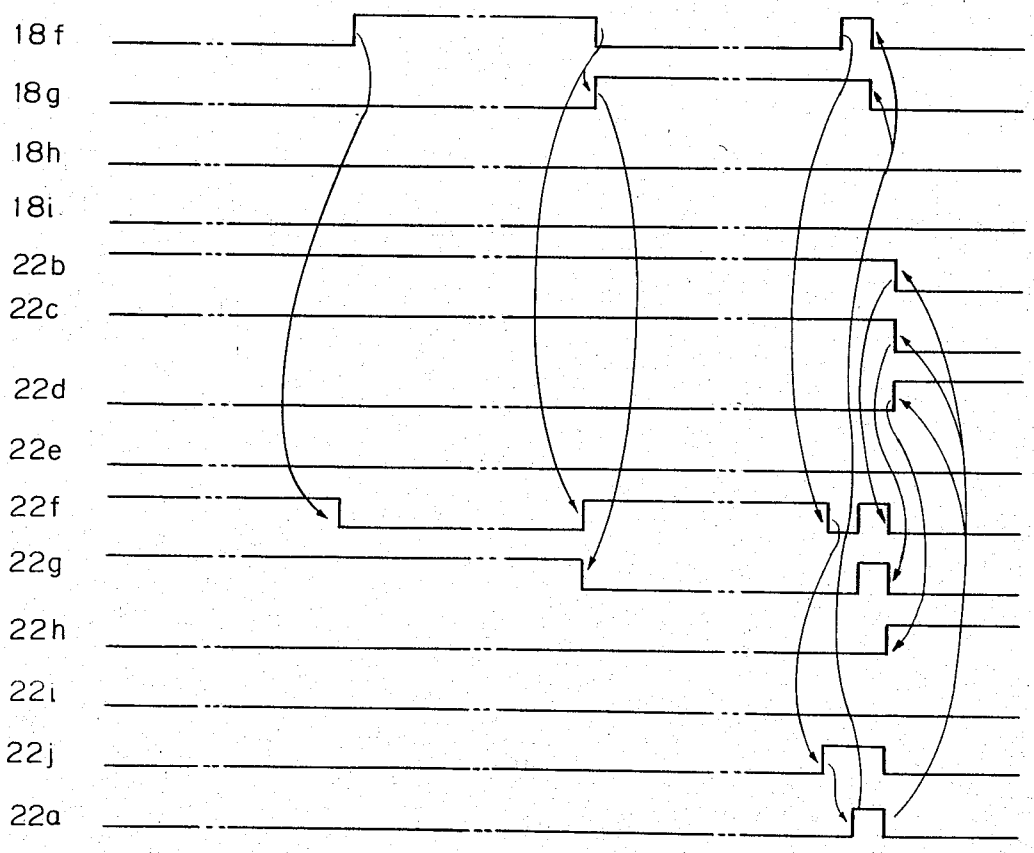
FIG. 6 is a time chart of various signals used in the circuit of FIG. 5.

FIG. 5 shows a more detailed circuit of the chime number control circuit 22 shown in FIG. 1. FIG. 6 is a time chart of various singals used in the circuit of FIG. 5. When the number setting switch 24 is actuated for setting the chime number, a switching singal providing circuit 68 comprising flip-flops 70, 72 and AND gate 74 provides a switching singal. The switching singal is applied to counter circuit 76 comprising flip-flops 78,80, 82, 84 and gates 86, 88, 90, 92. Output signals 22*b*, 22*c*, 22*d*, 22*e* of the flip-flops 78, 80, 82, 84 are applied to a coincidence detection circuit 94 comprising exclusive OR gates 96, 98, 100, 102 and NOR gate 104 together with the signals 18*f*, 18*g*, 18*h*, 18*i*. A coincidence signal provided from the NOR gate 104 is applied to a reset signal generating circuit 106 comprising flip-flops 108, 110 and AND gate 112. The chime timing counter 18 is reset by the output signal 22*a* of the AND gate 112, as the above mention.

For example, as shown in FIG. 6, the counter circuit 76 is set to chime number "3" by actuating the switch 24, and then the output singals 22*b*, 22*c*, 22*d*, 22*e* of the flip-flops 78, 80, 82, 84 are set to H level, H level, L level and L level, respectively. In this state, when the signals 18*f*, 18*g*, 18*h*, 18*i* of the chime timing counter 18 become H, H, L and L level, respectively, by being counted the number of the pulses which appear in the signal 18*a* by the counter circuit 47 of the chime timing counter 18, the state of the signals 18*f*, 18*g*, 18*h*, 18*i* coincides with the state of the signals 22*b*, 22*c*, 22*d*, 22*e*. Therefore, all of the output signals 22*f*, 22*g*, 22*h*, 22*i* become L level, and then the output of the NOR gate 104 is changed to H level. Next, the single pulse appears in the output singal 22*a* of the reset signal generating circuit 106 in response to the H level signal 22*j*. By means of this pulse of the signal 22*a*, the chime timing counter 18 is reset, and the counter circuit 76 of the chime number control circuit 22 is advanced from its count value "3" to "4" for providing "4" chimes exactly on the next hour.

Figure 7:
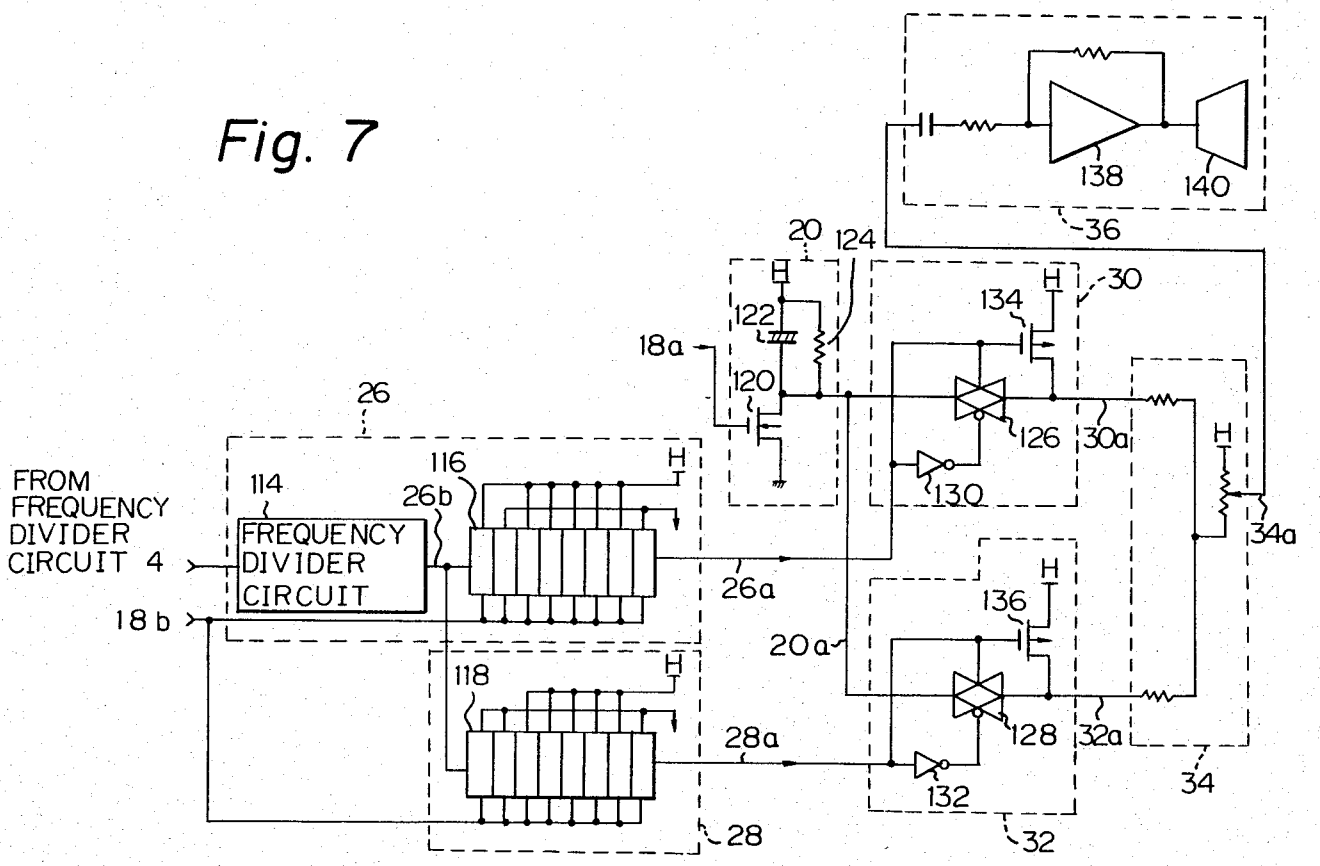
FIG. 7 is more detailed circuits of the first and second audio frequency signal generating circuits, etc. shown in FIG. 1.

FIG. 7 shows more detailed circuits of the first and second audio frequency signal generating circuits 26, 28, envelope generating circuit 20, etc. The first audio frequency signal generating circuit 26 comprises a frequency divider circuit 114 for frequency-dividing a signal from the frequency divider circuit 4 of the timepiece down to a frequency of 65.536 KHz($=2^{16}$ Hz), and a programmable frequency divider 116 for frequency-dividing an output signal 26*b* from the frequency divider circuit 114. The programmable frequency divider 116 is an eight-stage binary programmable frequency divider the frequency dividing ratio of which is set to 1/125. Accordingly, the output singal 26*b* (65.536 KHz=$2^{16}$ Hz) from the frequency divider circuit 114 is divided down to the singal 26*a* having a frequency ratio of 524 Hz.

The second audio frequency singal generating circuit 28 is constituted by a programmable frequency divider 118 for frequency-dividing the output singal 26*b* of the frequency divider circuit 114 in the first audio frequency signal generating circuit 26. The programmable frequency divider 118 is an eight-stage binary programmable frequency divider whose frequency dividing ratio is set to 1/124. Thus, the signal 26*b* (65.536 KHz=$2^{16}$ Hz) from the frequency divider circuit 114 is divided down to 529 Hz.

The programmable frequency divider 116, 118 of the first and second audio frequency signal generating circuit 26, 28 receive the reset singal 18*b* to their reset terminals.

The envelope generating circuit 20 comprises N-channel trnasistor 120 having a gate terminal receiving the envelope start signal 18*a*, and a condenser 122 and resistance 124 connected to each other in parallel. The N-channel transistor 120 goes to the conductive state by receiving the H level singal 18*a*, whereby the condenser 122 is charged. Then, the N-channel transistor 120 goes to the non-conductive state in response to the fall of the signal 18*a*, and the condenser 122 gradually discharges.

The analog switches 30, 32 comprise transmission gates 126, 128, inverter 130, 132 and P-channel transistor 134, 136, respectively. The transmission gate 126 receives the envelope signal 20*a* and the first audio frequency signal 26*a* and transmits the envelope signal 20*a* in accordance with the timing of the frequency of the signal 26*a*. The transmission gate 128 receives the envelope signal 20*a* and the second audio frequency signal 28*a* and transmits the envelope signal 20*a* in accordance with the timing of the frequency of the signal 28*a*.

The output signals 30*a*, 32*a* of the analog switches 30, 32 are applied to the mixing circuit 34 and are mixed in the mixing circuit 34.

The tone generating circuit 36 comprising an amplifier circuit 138 and a speaker 140 generates a sound in response to the mixed singal 34*a* from the mixing circuit 34.

Figure 8:
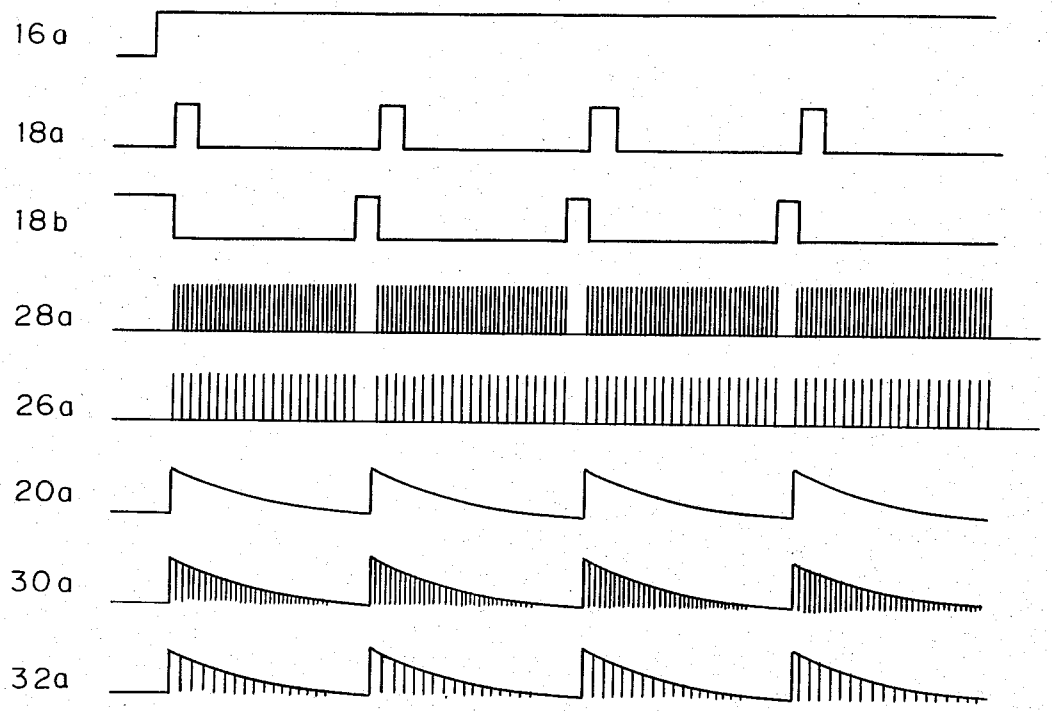
FIG. 8 and 9 are time charts of various signals used in the circuits of FIG. 7.
Figure 9:
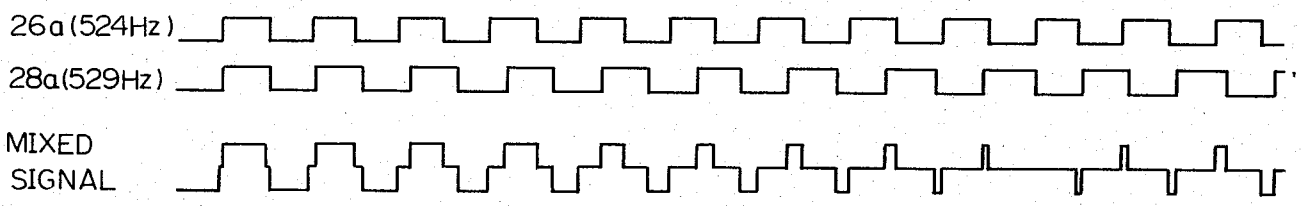

The operation of this circuitry will now be described using the time charts of FIGS. 8 and 9.

The chime start signal 16*a* from the chime control circuit 16 shown in FIG. 2 goes from the L level to H level exactly on the hour, in response to which the reset signal 18*b* from the chime timing counter 18 goes from H level to L level to release the programmable frequency dividers 116, 118 from the reset state, whereby the 65.536 KHz ($2^{16}$ Hz) signal 26*b* from the frequency divider circuit 114 starts being frequency divided. Simultaneously, a single positive pulse appears in the envelope start signal 18*a*, whereby the envelope generating circuit 20 generates the envelope signal 20*a* shown in FIG. 8. The envelope signal 20*a* and the 524 Hz and 529 Hz signals 26*a*, 28*a* are applied to the analog switches 30, 32. Accordingly, the output signal 30*a* of the analog switch 30 is an attenuated signal having a frequency of 524 Hz with the envelope attenuation, and the output signal 32*a* of the analog switch 32 is an attenuated signal having a frequency of 529 Hz with the envelope attenuation. The output signals 30*a*, 32*a* are mixed by the mixing circuit 34. The result is a signal whose power and pulse width vary periodically in accordance with the balance of the frequencies of the first and second audio frequency signals 26*a*, 28*a* as shown in FIG. 9. This mixed signal 34*a* is applied to the tone generating circuit 36, in response to which the tone generating circuit 36 produces a sound whose power and frequency component vary in small increase and decrease. When the envelope waveform from the envelope generating circuit 20 vanishes, the reset signal 18*b* from the chime timing counter 18 goes from the L level to H level to reset the programmable frequency dividers 116, 118. Thereafter, the chime number control circuit 22 determines whether the prescribed number of chimes have been issued. If the prescribed number has not been attained, the reset signal 18*b* again goes from the H level to L level, a single positive pulse arrears in the envelope start signal 18*a*, and the operation for producing the chime tone is repeated as described above.

According to the present invention, in addition to employing the envelope effect in which volume is diminished gradually with the passage of time, volume and the contained frequency components are varied periodically in accordance with the balance of the frequencies of the first and second audio frequency signals 26*a*, 28*a* in small increase and decrease while the volume is being diminished. This produces quality and depth in the manner of an actual mechanical bell toll.

Figure 10:
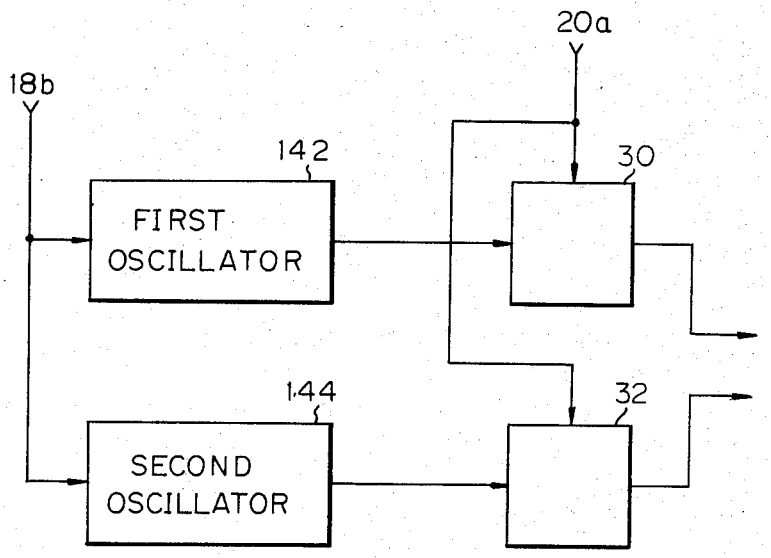
FIG. 10 is a modification of the first and second audio frequency signal generating circuits of the present invention.

In the illustrated embodiment, the frequency difference between the first audio frequency signal and second audio frequency signal is 5 Hz, though it may be changed to any value between 1 and 10 Hz. In addition, while the first audio frequency signal generating circuit 26 utilizes the signal from the timepiece frequency divider circuit 4, an independent oscillator may be provided. Although the first audio frequency signal generating circuit 26 and the second audio frequency generating circuit 28 both use a programmable frequency divider, first and second oscillators 142, 144 having different oscillation frequencies may be provided as shown in FIG. 10. Further, in the illustrated embodiment, the present invention is applied to the generation of a chime in a timepiece. However, it is obvious that the invention may be applied to an electronic musical instrument or the like.

I claim:

1. An electronic sound generating circuit for generating a bell toll and for an electronic device having standard signal generating means, comprising:

a first audio frequency signal generating circuit generating a first audio frequency signal;

a second audio frequency signal gnerating circuit generating a second audio frequency signal having a frequency which differs from said first audio frequency signal from 1 to 10 Hz;

an envelope generating circuit producing an envelope signal;

a first analog switch receiving said envelope signal and said first audio frequency signal for modulating said envelope signal by the frequency of said first audio frequency signal;

a second analog switch receiving said envelope signal and said second audio frequency signal for modulating said envelope signal by the frequency of said second audio frequency signal;

a mixing circuit for mixing said respective signals from said first and second analog switches to provide a mixed signal whose power and pulse width vary periodically in accordance with the balance of the frequencies of said first and second audio frequency signals; and a tone generating circuit generating said bell toll in response to said mixed signal.

2. An electronic sound generating circuit according to claim 1, in which said first audio frequency signal generating circuit comprises frequency divider circuit means for dividing a standard signal provided by said standard signal generating means to said first audio frequency signal having a predetermined frequency.

3. An electronic sound generating circuit according to claim 2, in which said frequency divider circuit means comprises a frequency divider circuit responsive to said standard signal to provide a lower frequency signal and a programmable frequency divider responsive to said lower frequency signal to provide said first audio frequency signal.

4. An electronic sound generating circuit according to claim 3, in which said second audio frequency generating circuit comprises a programmable frequency divider responsive to said lower frequency signal to provide said second audio frequency signal.

5. An electronic sound generating circuit according to claim 1, in which said first and second audio frequency signal generating circuits comprise first and second oscillators having different oscillation frequency from each other.

6. In an electronic timepiece having a standard signal generator for providing a standard signal and a frequency divider circuit for providing a frequency signal, the improvement comprising:

means for providing an envelope start signal and a reset release signal exactly on the hour;

an envelope generating circuit responsive to said envelope start signal to provide an envelope signal;

a first audio frequency signal generating circuit responsive to said reset release signal to provide a first audio frequency signal;

a second audio frequency signal generating circuit responsive to said reset release signal to provide a second audio frequency signal having a frequency differing from said first audio frequency signal by from 1 to 10 Hz;

a first analog switch receiving said envelope signal and said first audio frequency signal for modulating said envelope signal by the frequency of said first audio frequency signal;

a second analog switch receiving said envelope signal and said second audio frequency signal for modulating said envelope signal by the frequency of said second audio frequency signal;

a mixing circuit for mixing said respective signals from said first and second analog switches to provide a mixed signal whose power and pulse width vary periodically in accordance with the balance of the frequencies of said first and second audio frequency signals; and a tone generating circuit generating said bell toll in response to said mixed signal.

7. The improvement according to claim 6, in which said envelope start signal and reset release signal comprises an hour contact providing a signal on the hour, a chime control circuit responsive to the signal from said hour contact for providing a chime start signal, a chime timing counter responsive to said chime start signal for providing said envelope start signal, said reset release signal and a count signal which includes a count value of a chime number, and a chime number control circuit, which detects whether said count signal attains a value set for the count therein, providing a chime stop signal to said chime timing counter when the set value is attained.

* * * * *